US009438995B2

(12) United States Patent
Kawano

(10) Patent No.: US 9,438,995 B2
(45) Date of Patent: Sep. 6, 2016

(54) AUDIO SIGNAL PROCESSING CIRCUIT

(75) Inventor: Seiji Kawano, Saitama-ken (JP)

(73) Assignee: SEMICONDUCTOR COMPONENTS INDUSTRIES, LLC, Phoenix, AZ (US)

( * ) Notice: Subject to any disclaimer, the term of this patent is extended or adjusted under 35 U.S.C. 154(b) by 323 days.

(21) Appl. No.: 13/593,723

(22) Filed: Aug. 24, 2012

(65) Prior Publication Data

US 2013/0051581 A1 Feb. 28, 2013

(30) Foreign Application Priority Data

Aug. 24, 2011 (JP) ..... 2011-182835

(51) Int. Cl.
*H04R 3/04* (2006.01)

(52) U.S. Cl.
CPC ..... *H04R 3/04* (2013.01); *H04R 2499/13* (2013.01); *H04R 2499/15* (2013.01)

(58) Field of Classification Search
CPC H04R 3/04; H04R 2499/15; H04R 2499/13; H04R 1/002; H04R 1/005; H04R 3/06; H04R 3/08; H04R 1/10; H04R 2430/03; H04S 7/307; G10H 1/0091; G10H 1/06; G10H 1/12; G10H 1/16; H03G 5/00; H03G 5/04; H03G 5/16; H03G 5/165; H03G 5/18; H03G 5/24
USPC ..... 381/61, 63, 98, 103, 107
See application file for complete search history.

(56) References Cited

U.S. PATENT DOCUMENTS 3,794,936 A * 2/1974 Poschenrieder et al. ... 333/28 R
4,130,726 A * 12/1978 Kates et al. ..... 381/98
4,198,543 A 4/1980 Schertz et al.
4,569,076 A * 2/1986 Holman ..... 381/82
8,150,066 B2 * 4/2012 Kubo ..... 381/98
8,369,538 B2 * 2/2013 Akiyama et al. ..... 381/98
8,582,784 B2 * 11/2013 Minnaar ..... 381/98
8,615,093 B2 * 12/2013 Hung et al. ..... 381/98
2006/0274903 A1 12/2006 Aoki et al.

(Continued)

FOREIGN PATENT DOCUMENTS

CN 1726650 A 1/2006
CN 101170302 A 4/2008

(Continued)

OTHER PUBLICATIONS

EPO English translation of CN101170302A.

(Continued)

*Primary Examiner* — Vivian Chin
*Assistant Examiner* — Jason R Kurr

(57) ABSTRACT

An audio signal processing circuit includes: a first low-pass filter configured to pass a component whose frequency is in a band lower than a lowest reproducible frequency of a speaker out of an audio signal inputted for reproduction by the speaker; a first high-pass filter substantially similar in phase characteristics to the first low-pass filter configured to pass a component whose frequency is in a band higher than the lowest reproducible frequency of the speaker out of the audio signal inputted for reproduction by the speaker; a harmonic generation unit configured to generate a harmonic from the audio signal having passed through the first low-pass filter; and a first addition unit configured to add the audio signal according to an output of the harmonic generation unit to the audio signal according to an output of the first high-pass filter.

15 Claims, 8 Drawing Sheets

(56) References Cited

U.S. PATENT DOCUMENTS

| | | | | |
|---|---|---|---|---|
| 2009/0041265 | A1* | 2/2009 | Kubo | H04R 3/04 381/98 |
| 2011/0142258 | A1* | 6/2011 | Beer | 381/98 |
| 2012/0106742 | A1* | 5/2012 | Bharitkar | H03G 3/3005 381/17 |

FOREIGN PATENT DOCUMENTS

| | | | |
|---|---|---|---|
| CN | 101459865 | A | 6/2009 |
| JP | 2005-278158 | A | 10/2005 |
| JP | 2007-184990 | A | 7/2007 |

OTHER PUBLICATIONS

EPO English translation of CN101459865A.

Actions on the Merits for Copending U.S. Appl. No. 13/572,171, filed Aug. 10, 2012.

* cited by examiner

AUDIO SIGNAL PROCESSING CIRCUIT

This application claims the benefit of priority to Japanese Patent Application No. 2011-182835, filed Aug. 24, 2011, of which full contents are incorporated herein by reference.

CROSS REFERENCE TO RELATED APPLICATION

Related subject matter is contained in a co-pending patent application Ser. No. 13/572,171, filed Aug. 10, 2012, entitled "Audio Signal Processing Circuit," invented by the inventor hereof and assigned to the assignee hereof.

BACKGROUND OF THE INVENTION

1. Field of the Invention

The present invention relates to an audio signal processing circuit.

2. Description of the Related Art

With the recent progress of miniaturization and thinning of various audio equipment such as thinning of a TV set and miniaturization of a sound reproducing device, speakers for outputting a sound have been also miniaturized.

Accordingly, in order to compensate for insufficient reproduction capability of a low-pitched sound of such a small-sized speaker, a technique has been developed of extracting, from the original audio signal, an audio signal in a range lower than the lowest reproducible frequency of a speaker, generating a harmonic from this audio signal in the low range, and adding this harmonic to the original audio signal to output the result from a speaker (See Japanese Laid-Open Patent Application Publication No. 2005-278158, for example).

When a sound is reproduced by using such a technique, a sound in a low range, which is not actually outputted from the speaker, is heard by a human being as if it were outputted therefrom, thereby being able to improve audibility.

When an audio signal in a low range is extracted from the original audio signal, a low-pass filter is used, but the audio signal in the low range having passed through the low-pass filter has a phase delay according to a frequency.

When a harmonic is generated from this audio signal in the low range that has different phase delays generated according to the frequencies, even if a phase change does not occur in generating a harmonic, the generated harmonic has a phase different according to a frequency similarly to the audio signal before generating the harmonic.

Thus, since this harmonic and the original audio signal are different in phase according to the frequency, a waveform of an audio signal generated by adding these signals is distorted, resulting in a factor of deterioration in sound quality of a sound outputted from the speaker.

That is, the harmonic generated from the audio signal in a range lower than the lowest reproducible frequency of the speaker is added to the original audio signal and the result is outputted, thereby being able to reproduce a sound with good audibility with a low-pitched sound being emphasized, however, deterioration in the sound quality is caused by distortion of the waveform of the audio signal.

SUMMARY OF THE INVENTION

An audio signal processing circuit according to an aspect of the present invention, includes: a first low-pass filter configured to pass a component whose frequency is in a band lower than a lowest reproducible frequency of a speaker out of an audio signal inputted for reproduction by the speaker; a first high-pass filter substantially similar in phase characteristics to the first low-pass filter configured to pass a component whose frequency is in a band higher than the lowest reproducible frequency of the speaker out of the audio signal inputted for reproduction by the speaker; a harmonic generation unit configured to generate a harmonic from the audio signal having passed through the first low-pass filter; and a first addition unit configured to add the audio signal according to an output of the harmonic generation unit to the audio signal according to an output of the first high-pass filter.

Other features of the present invention will become apparent from descriptions of this specification and of the accompanying drawings.

BRIEF DESCRIPTION OF THE DRAWINGS

For more thorough understanding of the present invention and advantages thereof, the following description should be read in conjunction with the accompanying drawings, in which.

DETAILED DESCRIPTION OF THE INVENTION

At least the following details will become apparent from descriptions of this specification and of the accompanying drawings.

First Embodiment

Figure 1:
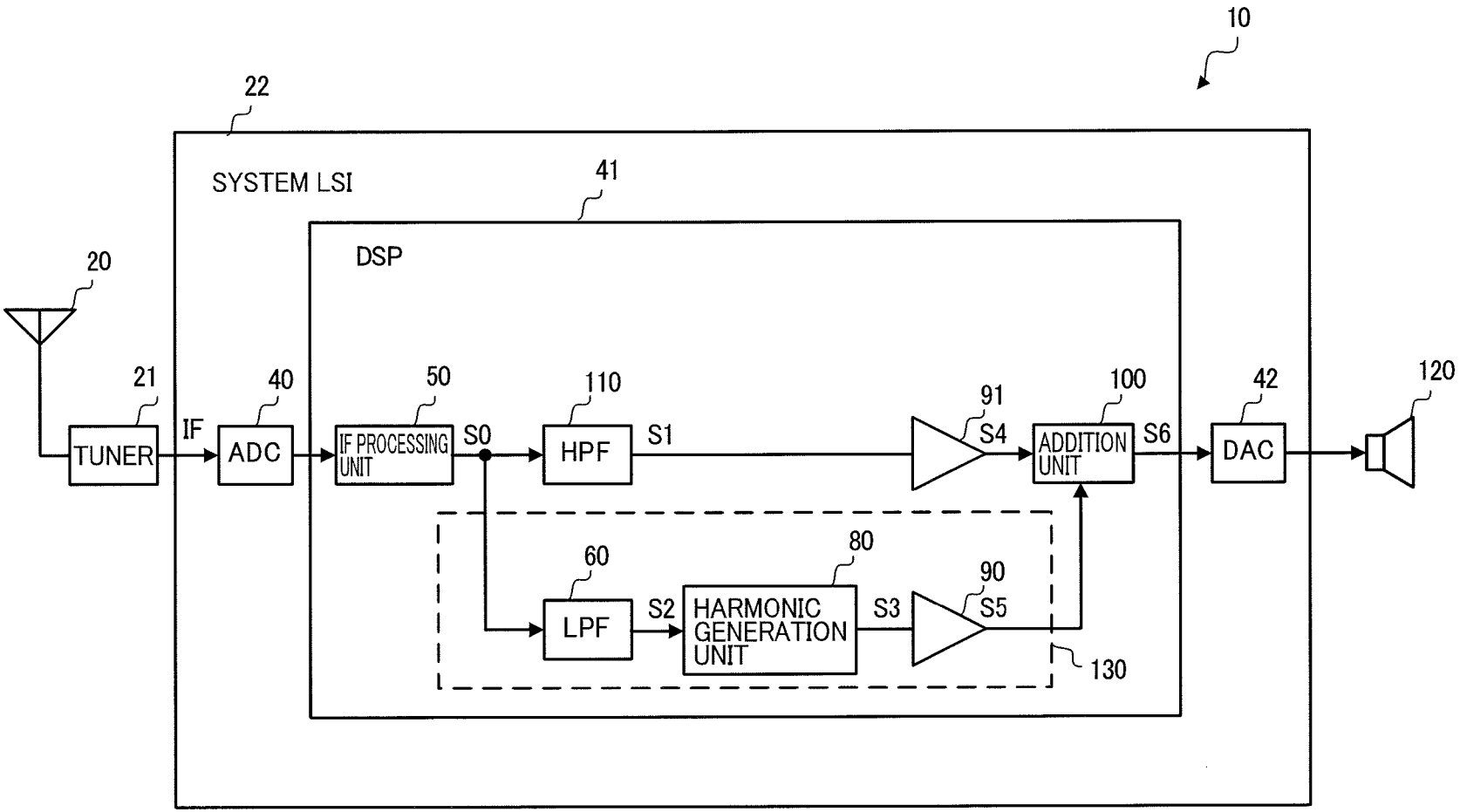
FIG. 1 is a diagram for explaining a first embodiment of the present invention.

FIG. 1 is a diagram illustrating a configuration of a radio receiver 10 according to an embodiment of the present invention. The radio receiver 10 is provided in a car stereo device (not shown), for example, and includes an antenna 20, a tuner 21, a system LSI (Large Scale Integration) 22, and a speaker 120.

The tuner 21 is configured to extract a broadcast signal of a designated receiving station from FM (Frequency Modulation) multiplex broadcast signals received by the antenna 20, for example, convert the broadcast signal into an IF signal, and output the converted signal.

The system LSI 22 includes an AD converter (ADC) 40, a digital signal processing circuit (DSP) 41, and a DA converter (DAC) 42.

The AD converter 40 is configured to convert the IF signal outputted from the tuner 21 into a digital signal, and output the converted signal to the DSP 41.

The DSP 41 (audio signal processing circuit) is configured to generate an audio signal, covert the audio signal, and output the converted audio signal, so that sound quality of a sound outputted from the speaker 120 is improved and audibility is improved.

The DA converter 42 is configured to convert the audio signal outputted from the DSP 41 into an analog signal. This analog signal is outputted as a sound from the speaker 120.

The DSP 41 according to an embodiment of the present invention is configured to generate a harmonic from an audio signal in a range lower than the lowest reproducible frequency (100 Hz, for example) of the speaker 120, add this harmonic to the original audio signal and output the result. This causes the sound in the low range, which is not actually outputted from the speaker 120, to be heard by a human being as if the sound were outputted therefrom, and thus the low-pitched sound heard from the speaker 120 is emphasized, thereby being able to improve audibility. Moreover, the DSP 41 according to an embodiment of the present invention can suppress distortion of a waveform of the audio signal and deterioration in the sound quality as will be described below in detail.

The DSP 41 includes an IF processing unit 50, a low-pass filter (first low-pass filter) 60, a high-pass filter (first high-pass filter) 110, a harmonic generation unit 80, amplifiers 90 and 91, and an addition unit 100.

Among them, the low-pass filter 60, the harmonic generation unit 80, and the amplifier 90 configure a harmonic adding unit 130. The harmonic adding unit 130 is configured to generate a harmonic from an audio signal in a range lower than the lowest reproducible frequency (100 Hz, for example) of the speaker 120 in the audio signals inputted for reproduction by the speaker 120.

Each of the blocks included in the DSP 41 is a functional block realized by a core (not shown) of the DSP 41 executing a program stored in a memory (not shown), for example. However, each or the blocks in the DSP 41 may be configured with hardware, for example.

The IF processing unit 50 is configured to execute demodulation processing for the IF signal and generate an audio signal S0.

The low-pass filter 60 is a filter configured to pass, in the audio signal S0, an audio signal in the band lower than the lowest reproducible frequency fc (e.g., 100 Hz) of the speaker 120. The high-pass filter 110 is a filter configured to pass, in the audio signal S0, an audio signal in the band higher than the lowest reproducible frequency of the speaker 120.

In an embodiment of the present invention, the audio signal outputted from the low-pass filter 60 is referred to as an audio signal S2 and the audio signal outputted from the high-pass filter 110 is referred to as an audio signal S1.

Figure 2:
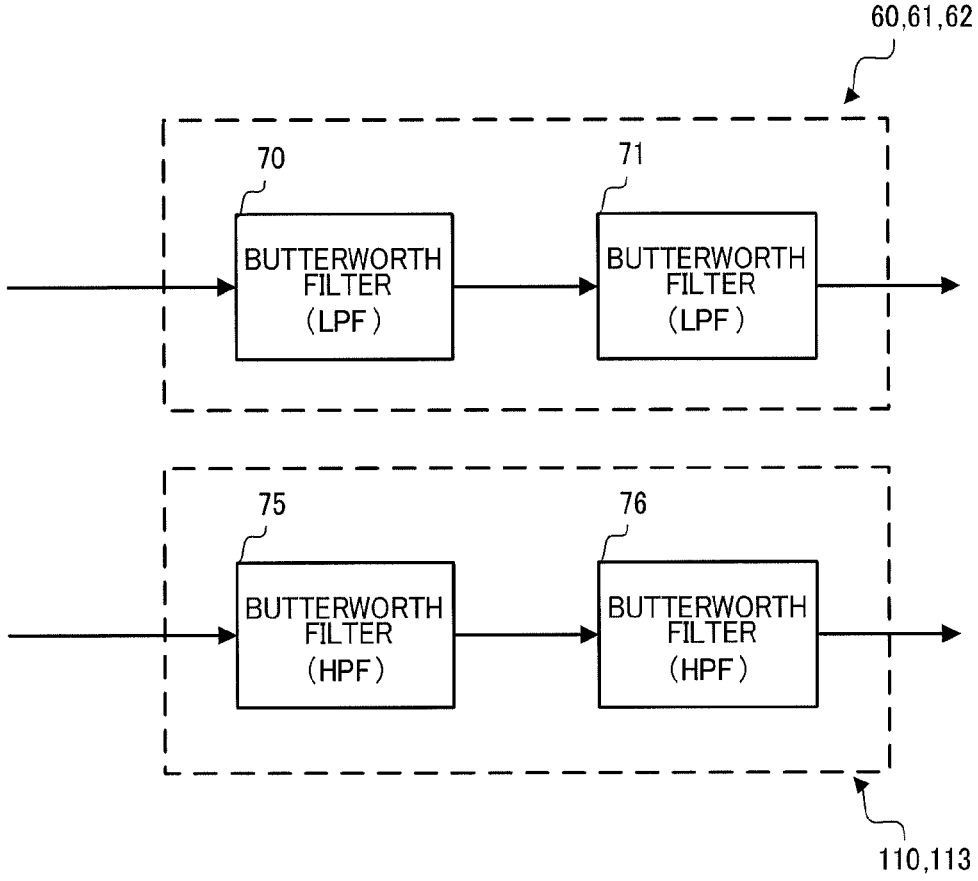
FIG. 2 is a diagram illustrating an example of a low-pass filter and a high-pass filter.

The low-pass filter 60 includes second-order Butterworth filters 70 and 71 configured to pass the audio signal in the band lower than the lowest reproducible frequency fc of the speaker 120 as illustrated in FIG. 2. Since the Butterworth filters 70 and 71 are connected in series, the Butterworth filters 70 and 71 constitute a so-called Linkwitz-Riley filter.

Figure 3:
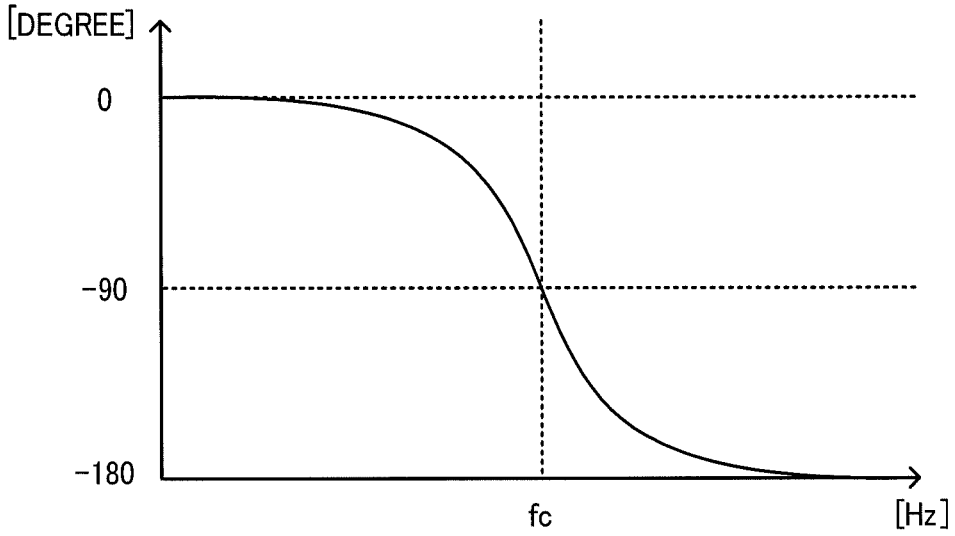
FIG. 3 is a diagram illustrating an example of a phase characteristic of a Butterworth filter.

FIG. 3 is a diagram illustrating phase characteristics (phase response) in each of the Butterworth filters 70 and 71. The Butterworth filters 70 and 71 are second-order low-pass filters, and thus if the frequency of a signal inputted to the Butterworth filters 70 and 71 is sufficiently low, the phase delay of the signal outputted therefrom is substantially 0 degrees. Whereas, if the frequency of the signal inputted to the Butterworth filters 70 and 71 is sufficiently high, the phase delay of the signal outputted therefrom is substantially 180 degrees. Moreover, if the frequency of the signal inputted to the Butterworth filters 70 and 71 is the lowest reproducible frequency fc of the speaker 120, the phase delay of the signal outputted therefrom is 90 degrees. Therefore, the low-pass filter 60 with such Butterworth filters 70 and 71 cascade-connected has the phase characteristics as illustrated in FIG. 4.

The high-pass filter 110 includes second-order Butterworth filters 75 and 76 configured to pass the audio signal in the band higher than the lowest reproducible frequency fc of the speaker 120. Thus, the Butterworth filters 75 and 76 also constitute a Linkwitz-Riley filter. Here, the filters are designed such that Q values of the Butterworth filters 70, 71, 75, and 76 are equal.

Figure 5:
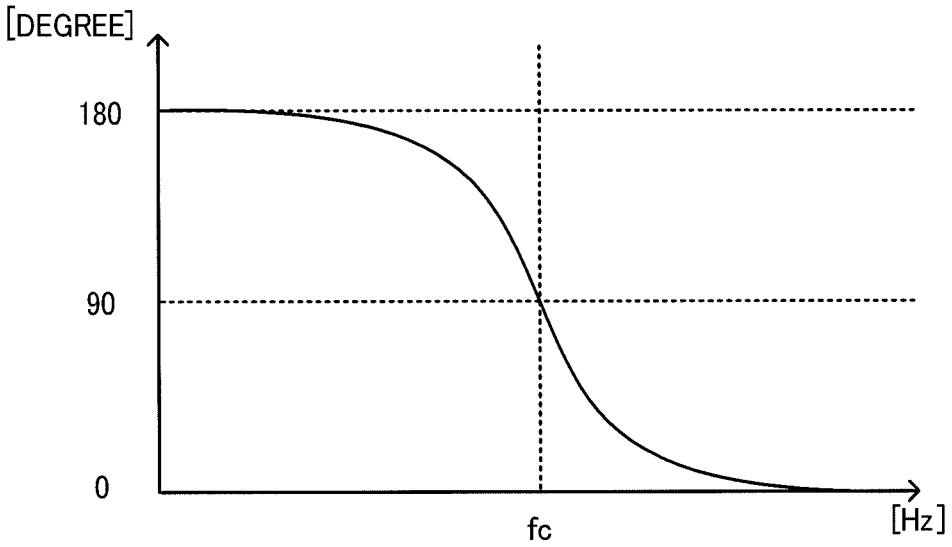
FIG. 5 is a diagram illustrating an example of a phase characteristic of a Butterworth filter.

FIG. 5 is a diagram illustrating the phase characteristics in each of the Butterworth filters 75 and 76. The Butterworth filters 75 and 76 are second-order high-pass filters, and thus if the frequency of the signal inputted to the Butterworth filters 75 and 76 is sufficiently low, the phase advance of the signal outputted therefrom is substantially 180 degrees. Whereas, if the frequency of the signal inputted to the Butterworth filters 75 and 76 is sufficiently high, the phase advance of the signal outputted therefrom is substantially 0 degrees. If the frequency of the signal inputted to the Butterworth filters 75 and 76 is the lowest reproducible frequency fc of the speaker 120, the phase advance of the signal outputted therefrom is 90 degrees. Therefore, the high-pass filter 110 with such Butterworth filters 75 and 76 cascade-connected has the phase characteristics as illustrated in FIG. 6.

Figure 4:
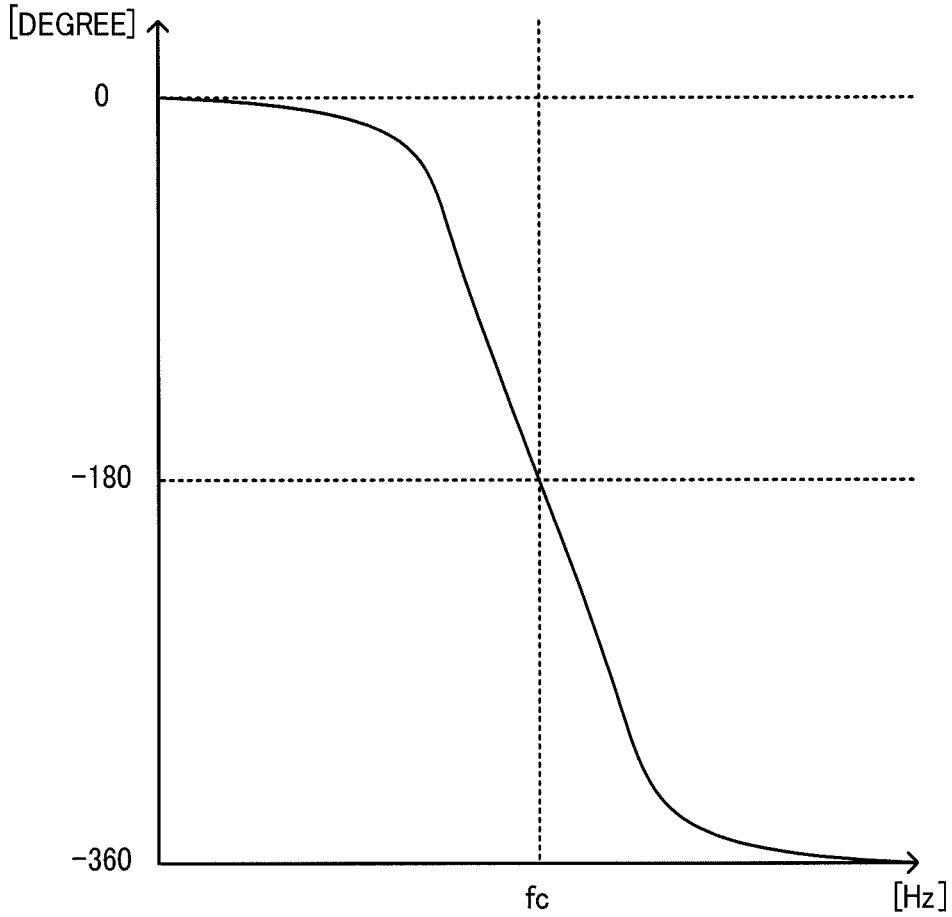
FIG. 4 is a diagram illustrating an example of a phase characteristic of a low-pass filter.
Figure 6:
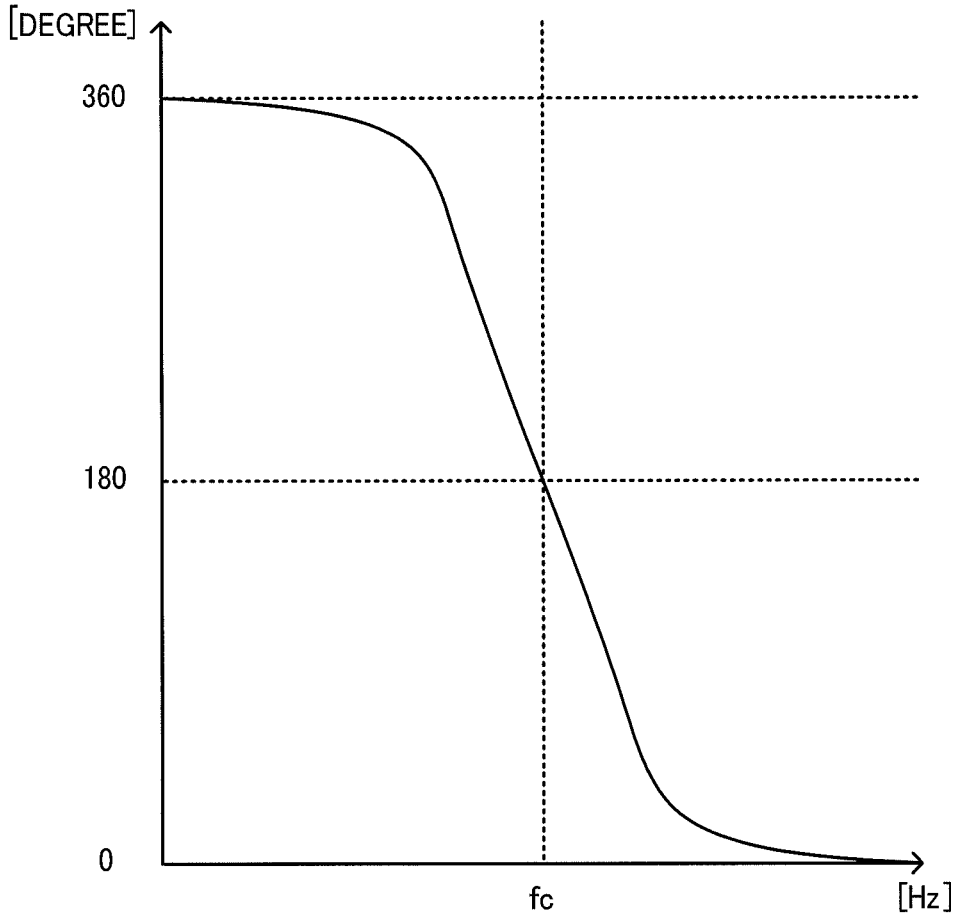
FIG. 6 is a diagram illustrating an example of a phase characteristic of a high-pass filter.

Incidentally, there is a phase shift of 360 degrees between the phase characteristics illustrated in FIG. 6 and the phase characteristics illustrated in FIG. 4, and the low-pass filter 60 and the high-pass filter 110 have phase characteristics similar. Thus, the audio signal S2 outputted from the low-pass filter 60 and the audio signal S1 outputted from the high-pass filter 110 are in phase with each other with respect to all the frequency components of the audio signal S0 inputted to the low-pass filter 60 and the high-pass filter 110.

Figure 7:
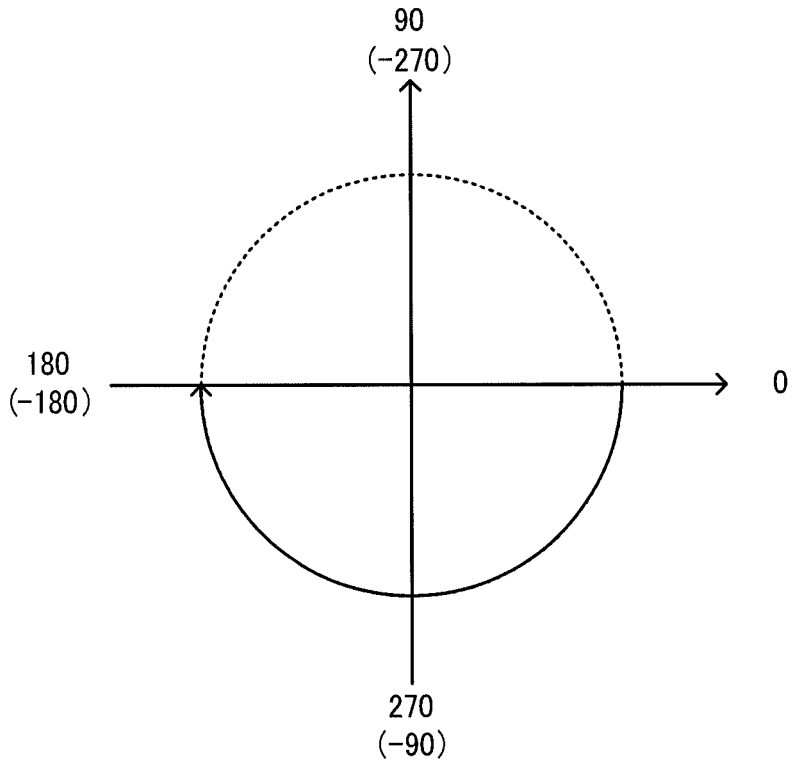
FIG. 7 is a diagram for explaining a phase delay of an audio signal having a frequency fc passing through the low-pass filter.
Figure 8:
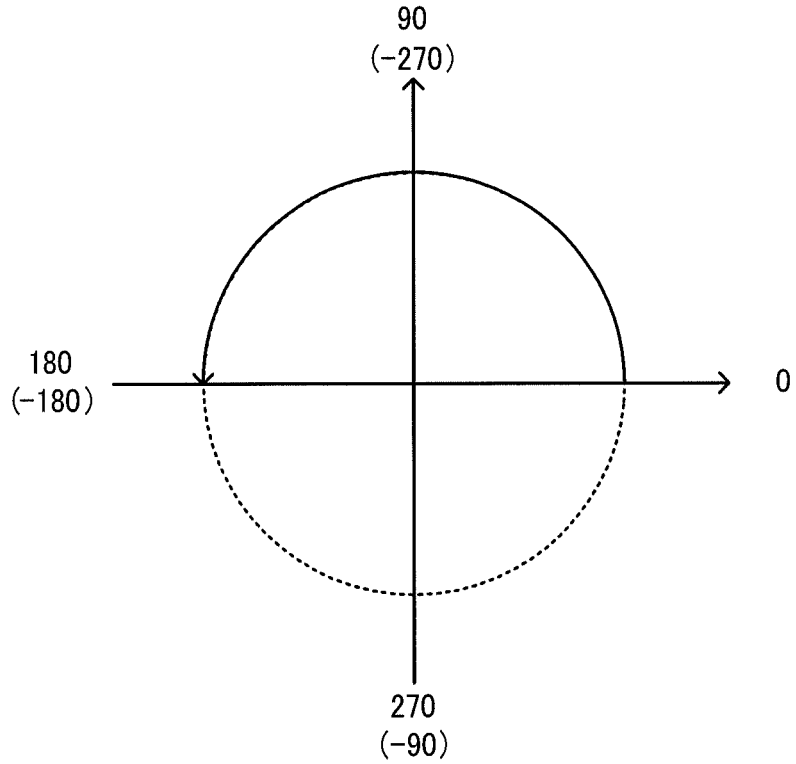
FIG. 8 is a diagram for explaining a phase advance of an audio signal having a frequency fc passing through a high-pass filter.

Specifically, as illustrated in FIG. 7, for example, if the audio signal S0 having the frequency fc is inputted to the low-pass filter 60, the audio signal S2 is delayed in phase by 180 degrees with respect to the audio signal S0. Whereas, as illustrated in FIG. 8, if the audio signal S0 having the frequency fc is inputted to the high-pass filter 110, the audio signal S1 is advanced in phase by 180 degrees with respect to the audio signal S0. As such, although the phase is delayed in the low-pass filter 60 and the phase is advanced in the high-pass filter 110, both of the phases of the audio signals S1 and S2 result in 180 degrees and the signals S1 and S2 are in phase with each other.

Subsequently, the harmonic generation unit 80 is configured to generate a harmonic from the audio signal S2 having passed through the low-pass filter 60. The harmonic generation unit 80 can be configured with a full-wave rectifier circuit, for example.

In this case, assuming that the audio signal S2=sin (wt), an audio signal S3 outputted from the harmonic generation unit 80 is a signal including an even-number-order harmonic as indicated as $S3=(2/\pi)+(4/\pi)*((1/3)*\sin(2\ wt)-(1/15)*\sin(4\ wt)+(1/35)*\sin(6\ wt)\ \ldots)$ after Fourier expansion.

The harmonic generation unit 80 can be realized with various circuits other than the full-wave rectifier circuit in order to generate a harmonic. If the full-wave rectifier circuit is used as above, the even-number-order harmonic can be generated, but various harmonics such as an odd-number-order harmonic or a harmonic in which an even-number-order harmonic and odd-number-order harmonic are mixed can be generated in accordance with a circuit realizing the harmonic generation unit 80.

The amplifier 90 is configured to amplify the audio signal S3 outputted from the harmonic generation unit 80 and output the amplified signal. The amplifier 91 is configured to amplify the audio signal S1 outputted from the high-pass filter 110 and outputs the amplified signal.

The amplifier 90 and the amplifier 91 may be set at amplification factors of equal values (factor of 1, for example), but one of the amplification factors can be set greater than the other, for example. In such a manner, the sound quality or tone of the sound outputted from the speaker 120 can be also controlled.

Moreover, it is also possible to make a configuration without the amplifiers 90 and 91. In this case, the audio signal S3 outputted from the harmonic generation unit 80 and the audio signal S1 outputted from the high-pass filter 110 are directly inputted to the addition unit 100 as audio signals S5 and S4, respectively.

The amplifiers 90 and 91 are designed such that the audio signals S3 and S1 become equal in phase change.

The addition unit (first addition unit) 100 is configured to add the audio signal S4 and the audio signal S5 and output an audio signal S6 to the DA converter 42. The DA converter 42 is configured to convert the audio signal S6 outputted from the addition unit 100 into an analog signal for reproduction by the speaker 120.

As such, the DSP 41 according to an embodiment of the present invention is configured to extract, using the low-pass filter 60, the audio signal S2 in a range lower than the lowest reproducible frequency of the speaker 120 in the audio signal S0 inputted for reproduction by the speaker 120, while the DSP 41 is configured to also extract the audio signal S1 in a range higher than the lowest reproducible frequency of the speaker 120 from the audio signal S0 using the high-pass filter 110 having the substantially equal phase characteristics as those of the low-pass filter 60. Thus, the audio signal S2 and the audio signal S1 can be made in phase over all frequencies.

Since the amplifiers 90 and 91 are designed such that the audio signals become equal in phase change, the phase shift between the audio signal S5 and the audio signal S4 added by the addition unit 100 can be suppressed.

As such, the DSP 41 according to an embodiment of the present invention can suppress distortion in the waveform of the audio signal S6 outputted from the addition unit 100, thereby being able to suppress deterioration in the sound quality of the sound outputted from the speaker 120.

In an embodiment of the present invention, for the sake of simplification of explanation, such an example is illustrated that deterioration in sound quality of monaural sound is suppressed, but the same applies to the case where deterioration in sound quality of stereo sound is suppressed. If the deterioration in sound quality of stereo sound is suppressed, it is only necessary that harmonics are generated for an audio signal of an L channel and an audio signal of an R channel, respectively, as described above, and the harmonics are added to the original audio signals, respectively, for example. The same also applies to other embodiments which will be described below.

Second Embodiment

Figure 9:
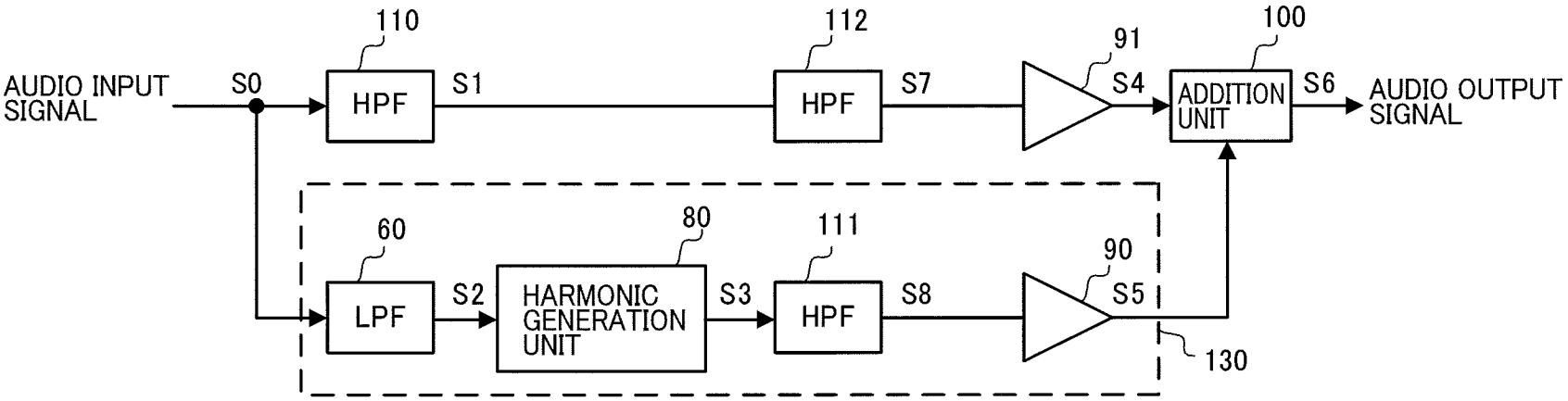
FIG. 9 is a diagram for explaining a second embodiment of the present invention.

FIG. 9 is a diagram for explaining a second embodiment of the DSP 41. The same reference numerals are given to the same constituent elements as those in the DSP 41 in a first embodiment illustrated in FIG. 1, in the following explanation.

As illustrated in FIG. 9, the DSP 41 according to a second embodiment of the present invention has a high-pass filter (second high-pass filter) 111 and a high-pass filter (third high-pass filter) 112 added to the DSP 41 in a first embodiment of the present invention.

The high-pass filter 111 is provided between the harmonic generation unit 80 and the addition unit 100, and is configured to pass an audio signal S8 in a band higher than the lowest reproducible frequency fc of the speaker 120 (100 Hz, for example) in the audio signal S3 with the harmonic generated by the harmonic generation unit 80.

That is, since the audio signal S2 inputted to the harmonic generation unit 80 is an audio signal in the band lower than the lowest reproducible frequency fc of the speaker 120, the audio signal S3 outputted from the harmonic generation unit 80 contains the audio signal in the band lower than the lowest reproducible frequency fc of the speaker 120, but a component whose frequency is in the band lower than the lowest reproducible frequency fc of the speaker 120 can be cut off by the high-pass filter 111.

Moreover, the high-pass filter 112 has characteristics substantially similar to those of the high-pass filter 111, is provided between the high-pass filter 110 and the addition unit 100, and is configured to pass an audio signal S7 in a band higher than the lowest reproducible frequency fc of the speaker 120 in the audio signal S1 having passed through the high-pass filter 110.

As such, by matching the phase characteristics of the high-pass filter 111 and the phase characteristics of the high-pass filter 112, the audio signal S3 and the audio signal S1 can be made equal in phase change, thereby being able to suppress the phase shift between the audio signal S5 and the audio signal S4 added by the addition unit 100 similarly to a first embodiment of the present invention. Thus, the DSP 41 according to an embodiment of the present invention can suppress the distortion in the waveform of the audio signal S6 outputted from the addition unit 100, and deterioration in the sound quality of the sound outputted from the speaker 120 can be suppressed.

Moreover, the audio signal S5 inputted to the addition unit 100 is an audio signal with a component whose frequency is in the band lower than the lowest reproducible frequency fc of the speaker 120 is cut off by the high-pass filter 111, and the audio signal S4 inputted into the addition unit 100 is also an audio signal with a component whose frequency is in the band lower than the lowest reproducible frequency fc of the speaker 120 is cut off by the high-pass filter 112, and thus the audio signal S6 outputted from the addition unit 100 does not contain a component whose frequency is in the band lower than the lowest reproducible frequency fc of the speaker 120.

As a result, the speaker 120 is not vibrated with a frequency equal to or lower than a specified value (lowest reproducible frequency), thereby also being able to prevent breakage or a failure of the speaker 120.

Both when the audio signal S3 passes through the high-pass filter 111 and when the audio signal S1 passes through the high-pass filter 112, both the signals are advanced in phase. Thus, these high-pass filters 111 and 112 do not have to include the second-order Butterworths 75 and 76 as exemplified in FIG. 2 and the Linkwitz-Riley filter does not have to be configured, either.

It is needless to say that these high-pass filters 111 and 112 may include the second-order Butterworths 75 and 76 and the Linkwitz-Riley filter may be configured.

Third Embodiment

Figure 10:
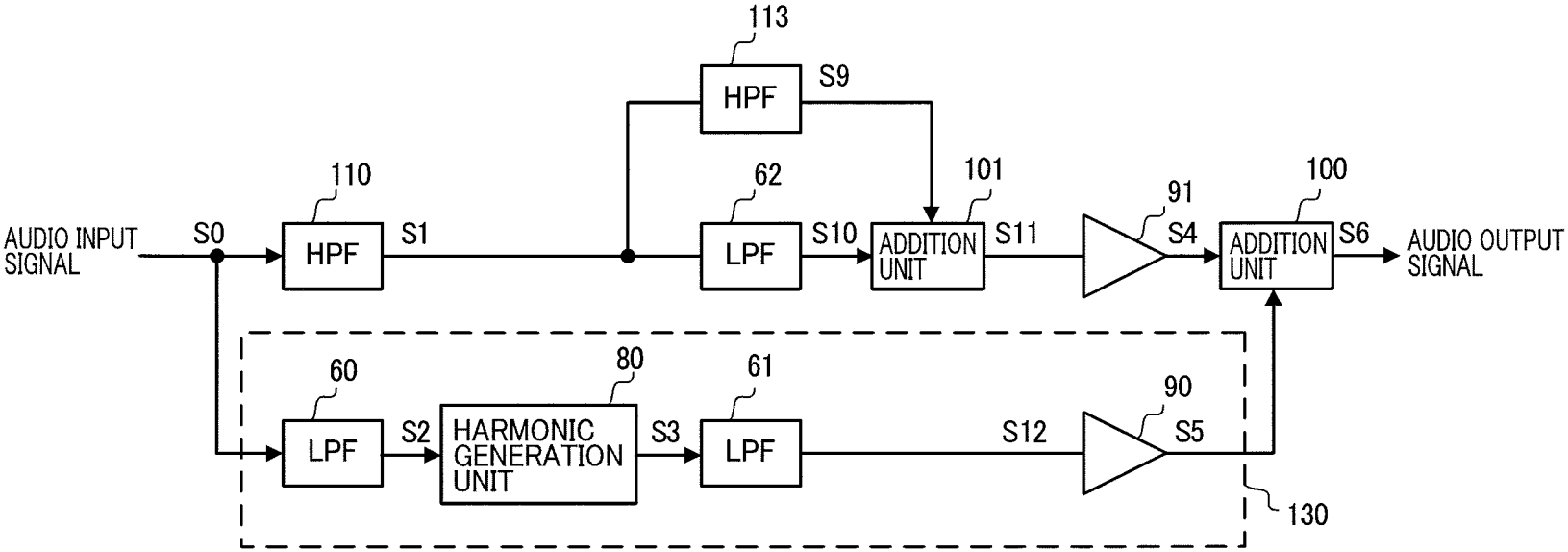
FIG. 10 is a diagram for explaining a third embodiment of the present invention.

FIG. 10 is a diagram for explaining a third embodiment of the DSP 41. The same reference numerals are given to the same constituent elements as those in the DSP 41 in a first embodiment illustrated in FIG. 1, in the following explanation.

As illustrated in FIG. 10, the DSP 41 according to a third embodiment of the present invention has a low-pass filter (second low-pass filter) 61, a low-pass filter (third low-pass filter) 62, a high-pass filter (fourth high-pass filter) 113, and an addition unit (second addition unit) 101 added to the DSP 41 of a first embodiment of the present invention.

The low-pass filter 61 is provided between the harmonic generation unit 80 and the addition unit 100, and is configured to pass a component whose frequency is in the band lower than a predetermined frequency, in the audio signal S3 with the harmonic generated by the harmonic generation unit 80.

That is, the component whose frequency is in the band higher than the predetermined frequency, in the harmonic contained in the audio signal S3 outputted from the harmonic generation unit 80, can be cut off by the low-pass filter 61.

Here, it is preferable that this predetermined frequency is set at a value within a range from three to five times the lowest reproducible frequency fc of the speaker 120. For example, if the lowest reproducible frequency fc of the speaker 120 is 100 Hz, it is preferable to set the value within a range from 300 to 500 Hz. As such, by cutting off the audio signal having a frequency higher than the frequency within the range of three to five times the lowest reproducible frequency fc of the speaker 120, in the audio signal S3 generated by the harmonic generation unit 80, the unpleasant sound can be cut off from the sound outputted from the speaker 120, thereby being able to further improving audibility.

Subsequently, the low-pass filter 62 and the high-pass filter 113 are provided in parallel between the high-pass filter 110 and the addition unit 100.

The low-pass filter 62 is configured to pass an audio signal S10 in the band lower than the predetermined frequency, in the audio signal S1 having passed through the high-pass filter 110. Moreover, the high-pass filter 113 is configured to pass an audio signal S9 in the band higher than the predetermined frequency, in the audio signal S1 having passed through the high-pass filter 110.

The low-pass filter 62 is configured with a Linkwitz-Riley filter with the Butterworth filters 70 and 71 connected in series. The high-pass filter 113 is also configured with a Linkwitz-Riley filter with the Butterworth filters 75 and 76 connected in series.

Thus, the phase characteristics of the low-pass filter 62 and the phase characteristics of the high-pass filter 113 are substantially equal. Thus, the audio signal S9 and the audio signal S10 are in phase with each other with respect to each of the frequencies.

Therefore, even if the audio signal S9 and the audio signal S10 are added in the addition unit 101, distortion in the waveform of an audio signal S11 outputted from the addition unit 101 can be suppressed.

Since the audio signal S11 is generated by once separating the audio signal S1 into a component whose frequency is higher than the above predetermined frequency and a component whose frequency is lower than the predetermined frequency and adding them again, the audio signal has a waveform similar to that of the audio signal S1. That is, the low-pass filter 62, the high-pass filter 113, and the addition unit 101 configure an all-pass filter as a whole.

Moreover, the low-pass filter 61 is also configured with the Linkwitz-Reily filter with the Butterworth filters 70 and 71 connected in series, similarly to the low-pass filter 62.

Thus, the phase characteristics of the low-pass filter 61, the phase characteristics of the low-pass filter 62, and the phase characteristics of the high-pass filter 113 are all substantially equal. Thus, the audio signal S3 and the audio signal S1 can be made equal in phase change, thereby being able to suppress the phase shift between the audio signal S12 and the audio signal S11.

As a result, in a third embodiment of the present invention as well, the phase shift between the audio signal S5 and the audio signal S4 added in the addition unit 100 can be suppressed. Thus, with the DSP 41 according to an embodiment of the present invention, distortion in the waveform of the audio signal S6 outputted from the addition unit 100 can be suppressed, thereby being able to suppress deterioration in the sound quality of the sound outputted from the speaker 120.

Fourth Embodiment

Figure 11:
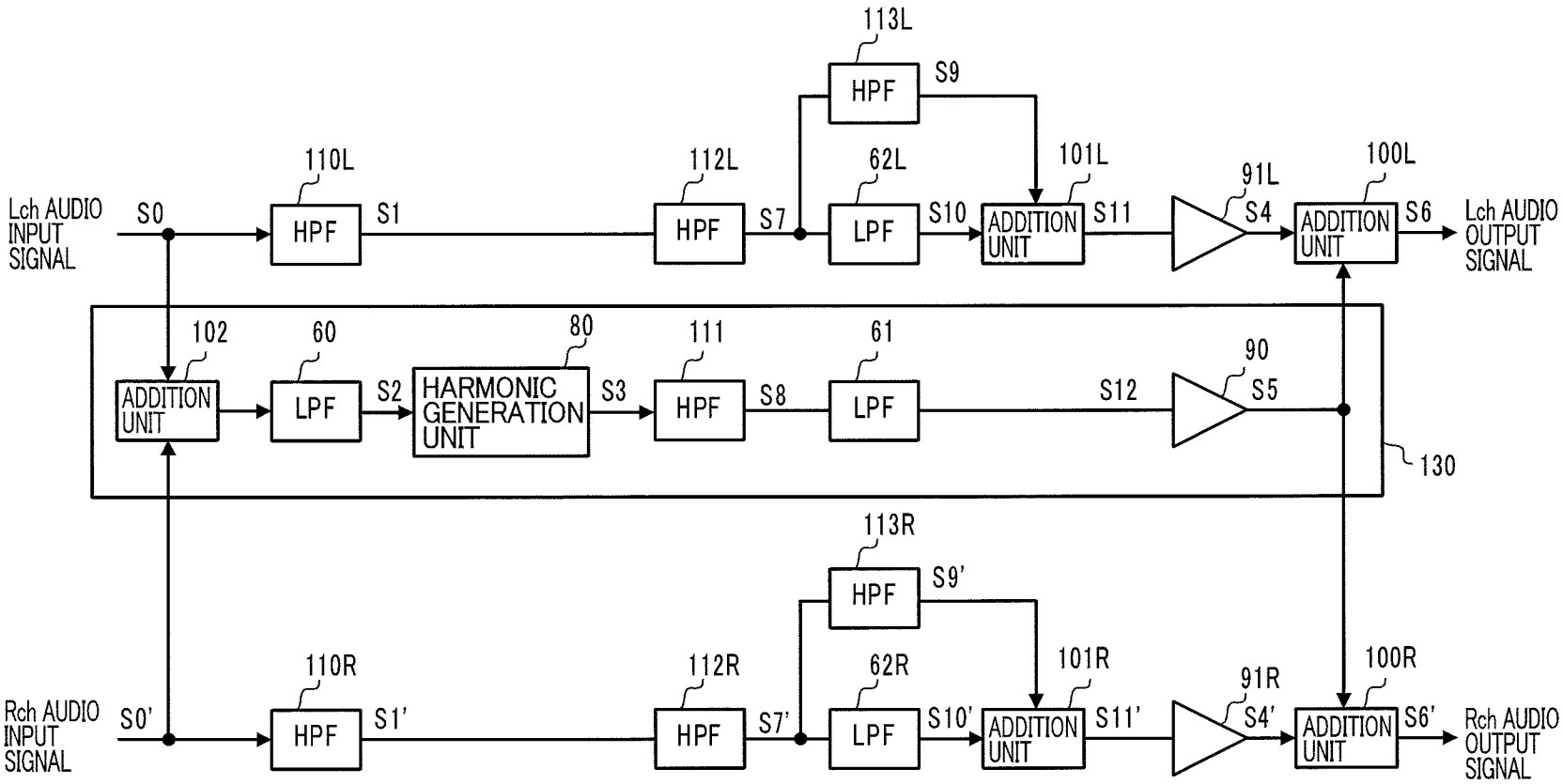
FIG. 11 is a diagram for explaining a fourth embodiment of the present invention.

FIG. 11 is a diagram for explaining a fourth embodiment of the DSP 41. The same reference numerals are given to the same constituent elements as those in the DSP 41 in a first embodiment illustrated in FIG. 1, in the following explanation.

As illustrated in FIG. 11, the DSP 41 according to a fourth embodiment of the present invention has the constituent elements, which are added in a second embodiment (the high-pass filter 111 and the high-pass filter 112), and the constituent elements, which are added in a third embodiment (the low-pass filter 61, the low-pass filter 62, the high-pass filter 113, and the addition unit 101), added to the DSP 41 in a first embodiment of the present invention, and is configured to have a harmonic adding unit 130 shared by the L channel and the R channel.

In order that the harmonic adding unit 130 is shared by the L channel and the R channel, an addition unit 102 is added to the harmonic adding unit 130 according to a fourth embodiment of the present invention.

The addition unit 102 is configured to add the audio signal S0 of the L channel and an audio signal S0' of the R channel, and output the result to the low-pass filter 60.

With the harmonic adding unit 130 being shared by the L channel and the R channel as in a fourth embodiment of the present invention, it becomes possible to streamline the device configuration, thereby being able to facilitate manufacturing of the DSP 41 and reduce costs, while reproduction of a stereo sound being enabled with high audibility and improved low pitched sound by the harmonic adding unit 130.

Hereinabove, embodiments of the present invention have been described in detail. In any of the embodiments, it is possible to prevent distortion in an audio signal caused when reproduction is performed with a sound in a range lower than the reproducible range of the speaker 120 being emphasized, by superposing the harmonic on the audio signal, thereby being able to suppress deterioration in sound quality.

In embodiments of the present invention described above, descriptions have been given of the examples where the low-pass filters 60, 61, and 62 each are configured with a Linkwitz-Reily filter with two Butterworth filters 70 and 71 connected in series. Further descriptions have been given of the examples where the high-pass filters 110 and 113 each are configured with a Linkwitz-Reily filter with two Butterworth filters 75 and 76 connected in series.

However, a configuration may be such that a filter with four first-order low-pass filters cascade-connected is used as each of the low-pass filters 60, 61, and 62, and a filter with four first-order high-pass filters cascade-connected is used as each of the high-pass-filters 110 and 113.

Alternatively, a configuration may be such that a filter with two second-order low-pass Chebyshev filters cascade-connected is used as each of the low-pass filters 60, 61, and 62, and a filter with two second-order high-pass Chebyshev filters cascade-connected is used as each of the high-pass-filters 110 and 113.

However, if the Chebyshev filter or the like is used, for example, a ripple or the like might occur in a signal outputted from the Chebyshev filter. Thus, using the Linkwitz-Reily filter including the Butterworth filters 70 and 71 as in an embodiment of the present invention, for example, can prevent deterioration in sound quality more effectively than using the Chebyshev filter.

The above embodiments of the present invention are simply for facilitating the understanding of the present invention and are not in any way to be construed as limiting the present invention. The present invention may variously be changed or altered without departing from its spirit and encompass equivalents thereof.

What is claimed is:

1. An audio signal processing circuit comprising:

a first low-pass filter configured to pass a component whose frequency is in a band lower than a lowest reproducible frequency of a speaker out of an audio signal inputted for reproduction by the speaker;

a first high-pass filter substantially similar in phase characteristics to the first low-pass filter configured to pass a component whose frequency is in a band higher than the lowest reproducible frequency of the speaker out of the audio signal inputted for reproduction by the speaker;

a harmonic generation unit configured to generate a harmonic from the audio signal having passed through the first low-pass filter;

a first addition unit configured to add the audio signal produced as an output of the harmonic generation unit to the audio signal that is produced as an output of the first high-pass filter wherein first addition unit produces an output signal having harmonic components;

a second low-pass filter provided between the harmonic generation unit and the first addition unit, the second low-pass filter configured to pass a component whose frequency is in a band lower than a predetermined frequency out of the harmonic generated by the harmonic generation unit;

a third low-pass filter substantially similar in phase characteristics to the second low-pass filter provided between the first high-pass filter and the first addition unit, the third low-pass filter configured to pass a component whose frequency is in a band lower than the predetermined frequency out of the audio signal having passed through the first high-pass filter;

a second high-pass filter substantially similar in phase characteristics to those of the second low-pass filter provided in parallel with the third low-pass filter between the first high-pass filter and the first addition unit, the second high-pass filter configured to pass a component whose frequency is in a band higher than the predetermined frequency out of the audio signal having passed through the first high-pass filter; and a second addition unit provided between the third low-pass filter as well as the second high-pass filter and the first addition unit, the second addition unit configured to add the audio signal having passed through the third low-pass filter and the audio signal having passed through the second high-pass filter.

2. The audio signal processing circuit according to claim 1, further comprising:

a third high-pass filter substantially similar in phase characteristics to the second high-pass filter provided between the first high-pass filter and the first addition unit, the third high-pass filter configured to pass a component whose frequency is in a band higher than the lowest reproducible frequency of the speaker out of the audio signal having passed through the first high-pass filter; and a fourth high-pass filter substantially similar in phase characteristics to those of the second low-pass filter provided in parallel with the third low-pass filter between the first high-pass filter and the first addition unit, the fourth high-pass filter configured to pass a component whose frequency is in a band higher than the predetermined frequency out of the audio signal having passed through the first high-pass filter.

3. The audio signal processing circuit according to claim 2, wherein the predetermined frequency is of a value within a range from three to five times the lowest reproducible frequency of the speaker.

4. The audio signal processing circuit according to claim 1, wherein the predetermined frequency is of a value within a range from three to five times the lowest reproducible frequency of the speaker.

5. The audio signal processing circuit according to claim 1, wherein the first low-pass filter and the first high-pass filter each is a Linkwitz-Reily filter.

6. An audio signal processing circuit comprising:

a first low-pass filter having an input for receiving an audio input signal, and an output and configured to pass a component whose frequency is in a band lower than a lowest reproducible frequency of a speaker;

a first high-pass filter substantially similar in phase characteristics to the low-pass filter having an input for receiving the audio input signal, and an output, and configured to pass a component whose frequency is in a band higher than the lowest reproducible frequency of the speaker;

a harmonic generation unit having an input coupled to the output of the first low-pass filter, and an output;

a second low-pass filter having an input coupled to the output of the harmonic generation unit, and an output, and configured to pass a component whose frequency is in a band lower than a predetermined frequency; and a first addition unit having a first input coupled to the output of the first high-pass filter, a second input coupled to the output of the harmonic generation unit, and an output for providing an audio output signal that comprises an audio signal produced as an output of the first high-pass filter and an audio signal produced as an output of the harmonic generation unit, the audio signal processing circuit further comprising:

a third low-pass filter substantially similar in phase characteristics to the second low-pass filter having an input coupled to the output of the first high-pass filter, and an output and configured to pass a component whose frequency is in a band lower than the predetermined frequency;

a second high-pass filter substantially similar in phase characteristics to those of the second low-pass filter having an input coupled to the output of the first high-pass filter, and an output and configured to pass a component whose frequency is in a band higher than the predetermined frequency; and a second addition unit having a first input coupled to the output of the second high-pass filter, a second input coupled to the output of the third low-pass filter, and an output coupled to the first input of the first addition unit.

7. The audio signal processing circuit of claim 6 further comprising:

wherein the second high-pass filter has an input coupled to the output of the harmonic generation unit, and an output coupled to the input of the second low-pass filter, and configured to pass a component whose frequency is in a band higher than the lowest reproducible frequency of the speaker; and a third high-pass filter substantially similar in phase characteristics to the second high-pass filter having an input coupled to the output of the first high-pass filter, and an output coupled to the first input of the first addition unit, and configured to pass a component whose frequency is in a band higher than the lowest reproducible frequency of the speaker.

8. The audio signal processing circuit according to claim 7, further comprising:

a fourth high-pass filter substantially similar in phase characteristics to those of the second low-pass filter having an input coupled to the output of the third high-pass filter, and an output and configured to pass a component whose frequency is in a band higher than the predetermined frequency.

9. The audio signal processing circuit according to claim 8, wherein the predetermined frequency is of a value within a range from three to five times the lowest reproducible frequency of the speaker.

10. The audio signal processing circuit according to claim 6, wherein the predetermined frequency is of a value within a range from three to five times the lowest reproducible frequency of the speaker.

11. The audio signal processing circuit according to claim 6, wherein the first low-pass filter and the first high-pass filter each is a Linkwitz-Reily filter.

12. A method comprising:

high-pass filtering components of an audio input signal above a predetermined frequency to provide a first signal;

low-pass filtering components of the audio input signal below the predetermined frequency to provide a second signal, wherein the low-pass filtering and the high-pass filtering have substantially the same phase characteristics with respect to frequency;

generating harmonics of frequencies of the second signal to provide a third signal;

lowpass filtering the harmonics of frequencies of the second signal to form a fourth signal; and adding a fifth signal corresponding to the first signal to the fourth signal to provide an audio output signal as a sum thereof wherein the audio output signal comprises a sum of a high-pass filter audio signal output and a lowpass-filtered harmonic generator signal output;

high-pass filtering the first signal above a predetermined frequency to form a sixth signal;

providing the fifth signal in response to the sixth signal;

high-pass filtering the third signal above the predetermined frequency to provide a seventh signal, wherein lowpass filtering the harmonics of frequencies of the second signal comprises lowpass filtering the seventh signal to form the fourth signal;

high-pass filtering the sixth signal above the predetermined frequency to form an eighth signal;

low-pass filtering the sixth signal below the predetermined frequency to form a ninth signal; and adding the eighth signal and the ninth signal to form the fifth signal.

13. The method of claim 12, further comprising:

setting the predetermined frequency as a value within a range from three to five times a lowest reproducible frequency of a speaker.

14. A method comprising:

high-pass filtering components of an audio input signal above a predetermined frequency to provide a first signal;

low-pass filtering components of the audio input signal below the predetermined frequency to provide a second signal, wherein the low-pass filtering and the high-pass filtering have substantially the same phase characteristics with respect to frequency;

generating harmonics of frequencies of the second signal to provide a third signal;

lowpass filtering the harmonics of frequencies of the second signal to form a fourth signal; and adding a fifth signal corresponding to the first signal to the fourth signal to provide an audio output signal as a sum thereof wherein the audio output signal comprises a sum of a high-pass filter audio signal output and a lowpass-filtered harmonic generator signal output;

high-pass filtering the first signal above a predetermined frequency to form a sixth signal;

low-pass filtering the first signal below the predetermined frequency to form a seventh signal;

adding the sixth signal to the seventh signal to form an eighth signal;

forming the fifth signal in response to the eighth signal;

low-pass filtering the third signal below the predetermined frequency to form a ninth signal; and forming the fourth signal in response to the ninth signal.

15. The method of claim 14, further comprising:

setting the predetermined frequency as a value within a range from three to five times a lowest reproducible frequency of a speaker.

* * * * *